US006518702B1

(12) United States Patent
Mori

(10) Patent No.: US 6,518,702 B1
(45) Date of Patent: Feb. 11, 2003

(54) FLAT DISPLAY DEVICE AND FABRICATING METHOD OF THE SAME

(75) Inventor: Hiroshi Mori, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/547,794

(22) Filed: Apr. 12, 2000

(30) Foreign Application Priority Data

Apr. 14, 1999 (JP) ..... 11-107085
Aug. 13, 1999 (JP) ..... 11-229340

(51) Int. Cl.[7] ..... H01J 17/49
(52) U.S. Cl. ..... 313/582; 313/586; 313/587
(58) Field of Search ..... 313/582, 583, 313/584, 585, 586, 587, 484

(56) References Cited

U.S. PATENT DOCUMENTS 5,744,909 A * 4/1998 Amano ..... 313/585
5,939,828 A * 8/1999 Matsuzaki et al. ..... 313/584

FOREIGN PATENT DOCUMENTS

| | | | |
|---|---|---|---|
| EP | 0 554 172 A | | 8/1993 |
| EP | 0 823 722 A2 | | 2/1998 |
| EP | 0 996 138 A2 | | 4/2000 |
| JP | 362044931 A | * | 2/1987 |

* cited by examiner

*Primary Examiner*—Vip Patel
*Assistant Examiner*—Joseph Williams
(74) *Attorney, Agent, or Firm*—Rader, Fishman & Grauer PLLC; Ronald P. Kananen, Esq.

(57) ABSTRACT

To improve high-definition and high-density display in a flat display device, and reduce driving power, namely, power consumption. First and second substrates 1 and 2 are disposed so as to oppose each other, and a discharge maintaining electrode group 5, which is constituted so that plural pairs of discharge maintaining electrodes 3 and 4 are disposed, is formed on the first substrate 1, and an address electrode group, which is constituted so that a plurality of address electrodes are disposed, is formed on the second substrate. Particularly plasma discharge display is executed by mainly utilizing cathode glow discharge so that spacing between the electrodes is made to be narrow, and high-definition and high-density display is possible.

9 Claims, 6 Drawing Sheets

FLAT DISPLAY DEVICE AND FABRICATING METHOD OF THE SAME

BACKGROUND OF THE INVENTION

1. Field of the Invention

The present invention relates to a flat display device for executing AC plasma discharge display and a fabricating method thereof.

2. Description of the Related Art

As a flat display device utilizing plasma discharge, for example, Japanese Patent Application Laid-Open No. 7-220641 (1995) discloses a display device.

As shown in a schematic exploded view of a main portion in FIG. 7, for example, in the example of the conventional flat display device, first and second substrates 101 and 102 which are made of glass substrates oppose each other with a predetermined interval and surroundings of the substrates are sealed airtightly so that a flat container is constituted.

A discharge maintaining electrode group 105, which is composed by arranging plural pairs of discharge maintaining electrodes 103 and 104 which are made of transparent electroconductive layer, for example, in parallel, is formed on an inner surface of the first substrate 101.

Partition walls 106 which are extended to a direction intersecting perpendicularly to an extended direction of the discharge maintaining electrodes are disposed in parallel at predetermined spacing, and address electrodes 107 are formed between the partition walls 106 in a stripe form, and fluorescent materials R, G and B, which emit lights of red, green and blue, for example, due to excitation by means of ultraviolet rays generated by plasma discharge, are applied between the partition walls 106 on an inner surface of the second substrate 102.

A necessary discharge starting voltage is applied between the selected address electrode 107 and one discharge maintaining electrode so that discharge is started in a portion where they cross each other, and a necessary AC voltage is applied between the paired discharge maintaining electrodes so that the discharge in this portion is maintained, and the fluorescent material positioned in the crossing portion is illuminated by an ultraviolet ray, for example, of an energy light emitted due to the discharge. In such a manner, luminous display is executed.

A conventional general plasma discharge type display device uses so-called negative glow discharge. The negative glow discharge takes place between electrodes which are disposed with spacing of 130 $\mu$m to 200 $\mu$m, for example.

Therefore, in this case, since the electrode gap, such as the gap between the paired discharge maintaining electrodes, cannot be enough small, a pixel pitch is naturally limited, and thus in the case of high-definition display, heightening of pixel density is hindered.

In the present invention, the high-definition and high-density display in the flat display device are improved, and a driving power, namely, power consumption is reduced.

SUMMARY OF THE INVENTION

Namely, in the present invention, in a flat display device, plasma discharge is allowed to take place by mainly utilizing cathode glow discharge.

A flat display device of the present invention is constituted so that first and second substrates are disposed so as to oppose each other, and a discharge maintaining electrode group which is constituted so that a plurality of discharge maintaining electrodes are disposed is formed on the first substrate, and an address electrode group which is constituted so that a plurality of address electrodes are disposed is formed on the second substrate, and particularly plasma discharge display is executed by cathode glow discharge.

In addition, a method of fabricating a flat display device according to the present invention includes:

the step of forming a discharge maintaining electrode group, which is constituted so that plural pairs of discharge maintaining electrodes are disposed with their mainly extending direction defined as a first direction along a surface of a first substrate, on the first substrate; the step of forming grid-state projecting bars which are constituted by projecting bar portions, which are extended to a direction crossing the discharge maintaining electrodes and disposed in parallel at necessary spacing, and intersecting projecting bar portions, which cross the projecting bar portions and are extended along between a pair of the discharge maintaining electrodes;.the step of forming a projecting wall group, which is constituted so that a plurality of projecting walls extending to a second direction along a surface of the second substrate are disposed in parallel, on the second substrate; the step of flying an electroconductive material onto the projecting walls from diagonally above a direction crossing the second direction and cladding the electroconductive material selectively to top portions of the projecting walls and side walls in vicinities of the projecting walls so as to form address electrodes, which are constituted by the electroconductive material formed on the top portions of the necessary projecting walls, on the second substrate; and the step of applying a fluorescent layer between the projecting. walls, wherein the first and second substrates oppose each other so that their directions face towards directions where they cross each other, and the projecting walls and the intersecting projecting bar portions at least work together so that spacing between the address electrodes and the discharge maintaining electrodes is set to a predetermined spacing.

According to the flat display device of the present invention, at least in the discharge maintaining, the cathode glow discharge can be allowed to take place, namely, the spacing between pairs of discharge maintaining electrodes can be set to be narrow, namely to less than 50 $\mu$m, i.e., not more than 20 $\mu$m. As a result, a pixel pitch can be reduced, and high-definition and high-density display can be executed.

In addition, in the present invention, since the cathode glow discharge takes place, a driving electric power can be reduced further than the case of a negative glow discharge, and an electricity-saving effect particularly in a large-screen display is improved. Namely, what the present invention refers to the cathode glow discharge is, as is clear from the object and effect, mainly the one, but also includes the case that another discharge mode which is incidentally generated is mixed.

In addition, according to the fabricating method of the present invention, in the case where the spacing between the first and second substrates is defined by the projecting bars and projecting walls formed respectively on the first and second substrates, the electroconductive material is deposited on the top portions of the projecting walls so that the address electrodes are formed on at least predetermined projecting walls. However, since the electroconductive material is allowed to fly from the diagonal direction, the electroconductive material can be formed isolatedly on the top portions and in the neighborhood of the projecting walls, and accordingly the address electrodes can be separated from each other at the same time when they are at least formed. As a result, the address electrodes can be easily disposed densely.

DESCRIPTION OF THE PREFERRED EMBODIMENTS

Figure 1:
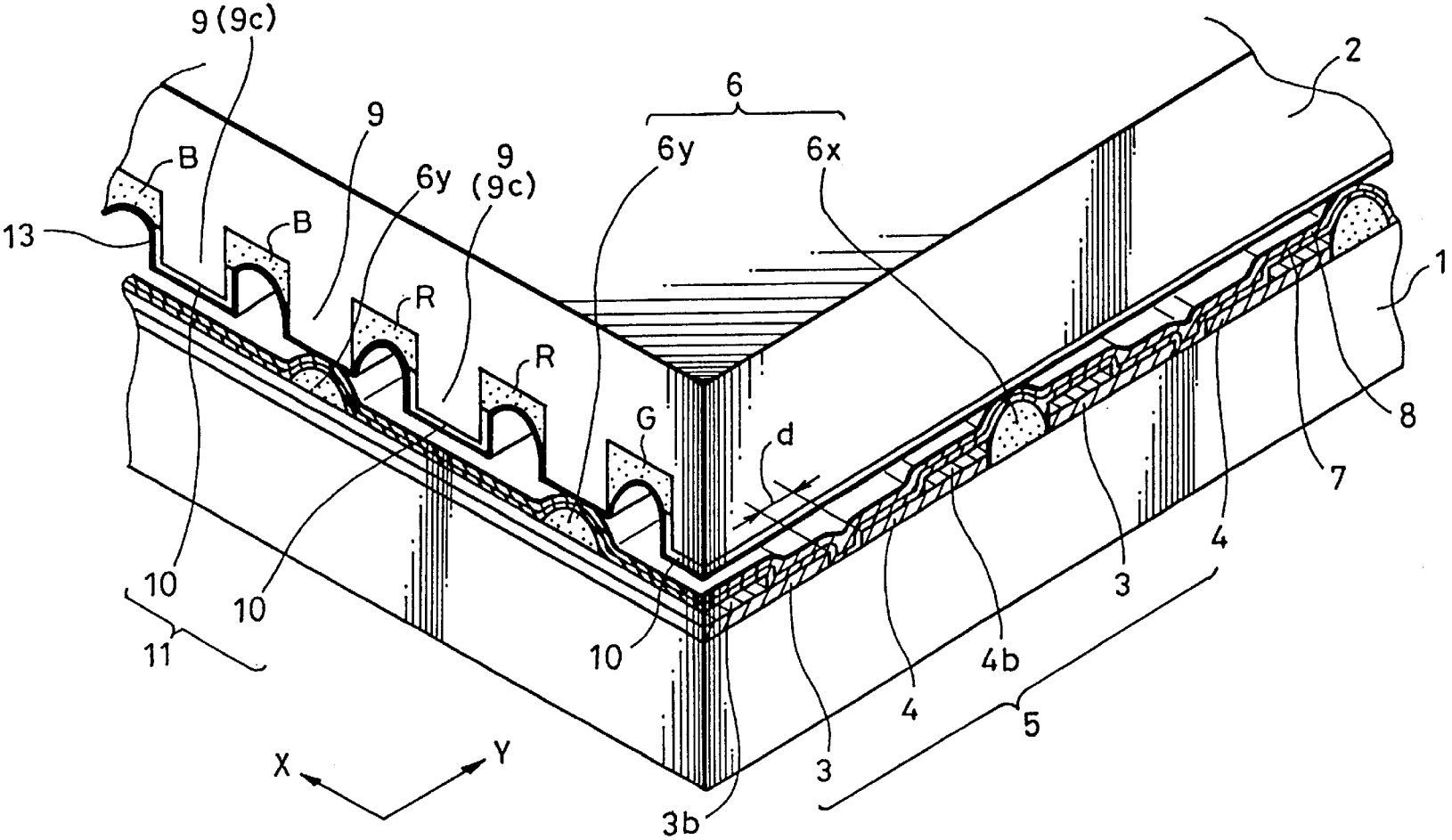
FIG. 1 is a schematic perspective view of a main portion of a flat display[] device according to one embodiment of the present invention.
Figure 2:
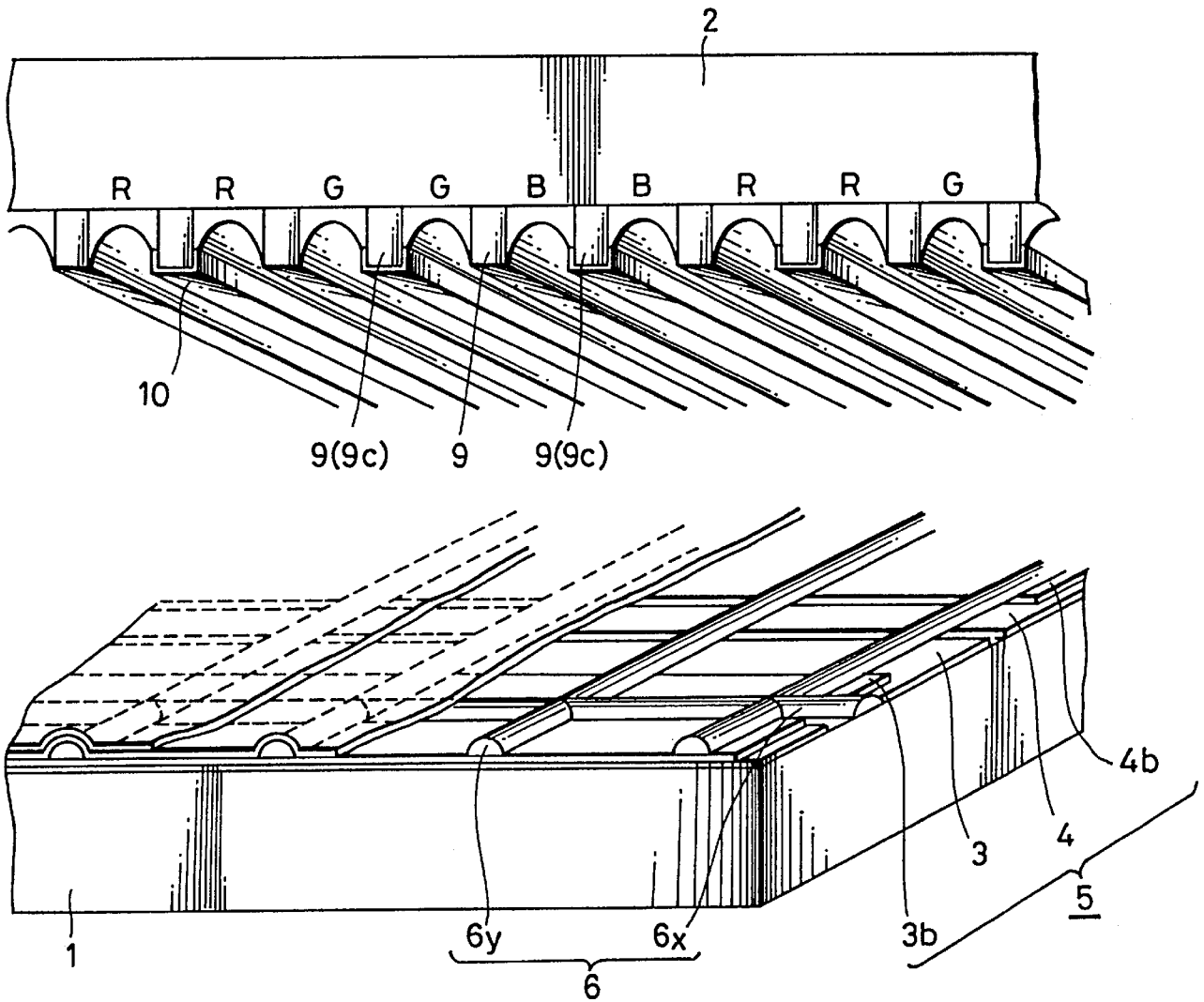
FIG. 2 is an exploded perspective view of the main portion of the flat display device according to one embodiment of the present invention.
Figure 3:
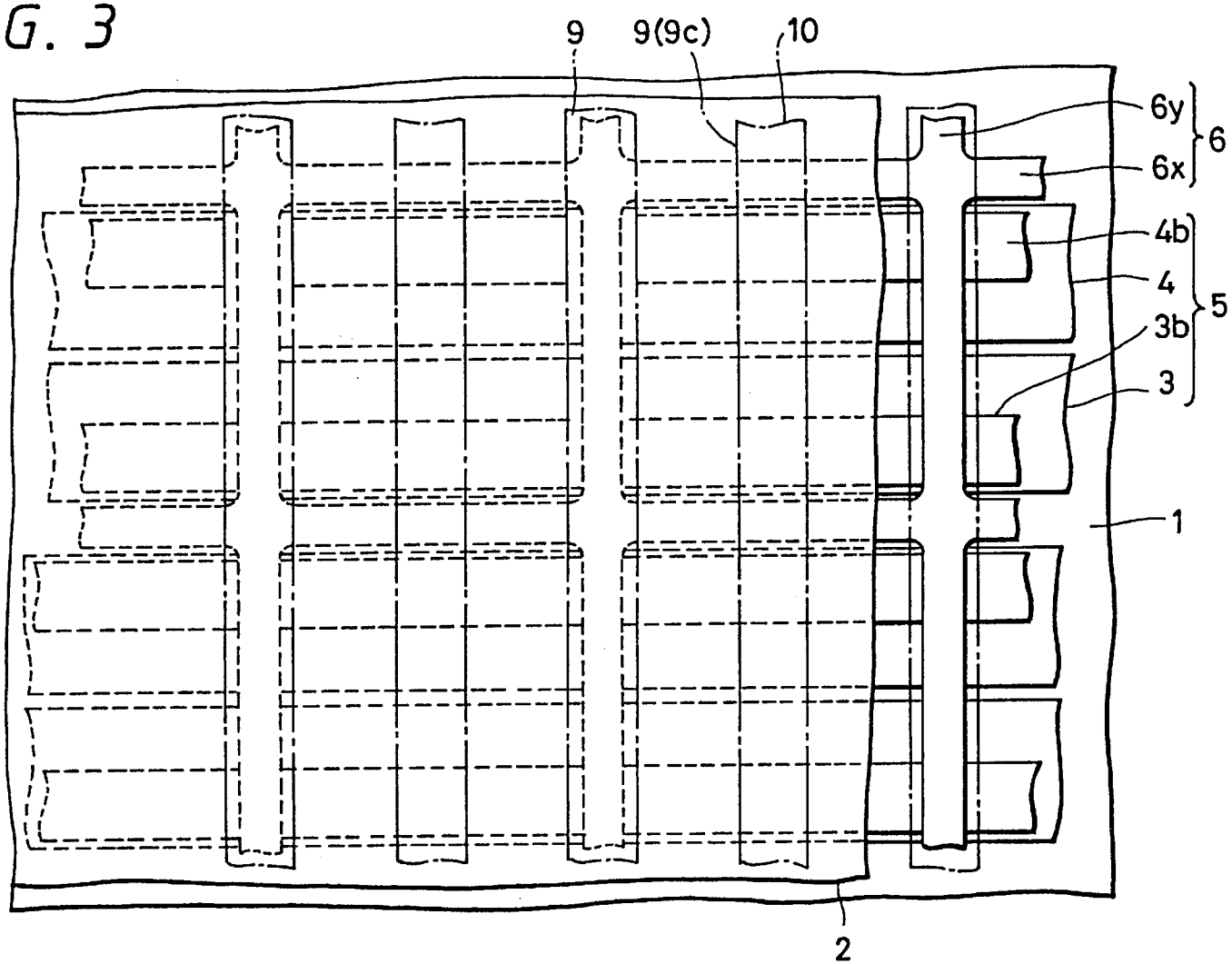
FIG. 3 is a rear view of the main portion of the flat display device according to one embodiment of the present invention.

There will be described below a flat display device according to one embodiment of the present invention with reference to the diagrams. FIG. 1 is a schematic perspective view showing a main portion of the flat display device, and FIG. 2 is an exploded perspective view showing the main portion. Moreover, FIG. 3 is a plan view viewed from a rear surface of the main portion. However, the present invention is not limited to these examples.

The flat display device of the present invention is constituted so that first and second substrates 1 and 2 which are made of a glass substrate, for example, oppose each other, and, not shown, surroundings of both the substrates 1 and 2 are sealed airtightly by a frit seal or the like.

This example relates to the case where luminous display is observed from: a side of the first substrate 1, and in this case, at least this first substrate 1 is made of a transparent glass substrate, for example, through which a display light is transmitted.

A discharge maintaining electrode group 5, which is constituted such that plural pairs of discharge maintaining electrodes 3 and 4 which are made of transparent electroconductive layers such as ITO (indium tin oxide) are disposed in parallel in a stripe form, for example, with their mainly extended direction defined as a first direction along the surface of the substrate 1, namely, a direction X in the diagram, is provided on an inner surface of the first substrate 1.

Counter spacing between the electrodes 3 and 4 are set to less than 50 $\mu$m where cathode glow discharge is possible, and preferably not more than 20 $\mu$m.

In the case where the discharge maintaining electrodes 3 and 4 are formed by transparent electroconductive layers, since their electroconductivity is comparatively low, so-called bus electrodes 3*b* and 4*b*, which are made of Al, for example, with excellent electroconductivity for compensating for the electroconductivity of the discharge maintaining electrodes 3 and 4, are deposited along the mainly extended direction of the discharge maintaining electrodes.

In addition, projecting bar portions 6*y*, which cross the discharge maintaining electrodes 3 and 4 are extended to a second direction Y perpendicularly intersecting the direction X, are formed in parallel at predetermined spacing, and simultaneously intersecting projecting bar portions 6*x* which cross the projecting bar portions 6*y* and are extended to the direction X, are formed so that a grid-state projecting bars 6 are formed on the first substrate 1.

The crossing projecting portions 6*x* are formed between pairs of discharge maintaining electrodes so as to or not to partially straddle the discharge maintaining electrodes 3 and 4.

A dielectric layer 7 is deposited onto a whole inner surface of the first substrate 1 with a thickness which is not more than half,of spacing between the discharge maintaining electrodes 3 and 4, and a surface layer 8, which has small work function and protects the electrodes and is made of MgO, for example, is formed thereonto.

In addition, stripe type projecting walls 9, for example, which extends along the second direction, i.e., the direction Y correspondingly to the projecting bar portions 6*y* of the projecting bar 6 on the first substrate 1 and are disposed one by one between the projecting bar portions 6*y*, are formed on an inner surface of the second substrate 2. Namely, the projecting walls 9 are formed at a pitch which is ½ of the pitch of the projecting bar portions 6*y*.

Moreover, address electrodes 10 are deposited in a stripe form on the extended direction of top portions of the projecting walls 9, particularly, top portions of projecting walls 9*c* positioned between the projecting bar portions 6*y* so that an address electrode group 11 is formed.

In this structure, the projecting walls 9 and the projecting bar portion 6 are made to come in contact with each other or join each other and their height is determined so that the spacing between the first and second substrates 1 and 2 as well as the spacing between the address electrodes 10 and the discharge maintaining electrode 3 or 4 which becomes a discharge starting electrode are set to less than 50 $\mu$m, preferably not more than 20 $\mu$m, namely, these spacing are set so that the cathode glow discharge is possible, and namely, the cathode glow discharge takes place.

Fluorescent layers which emit lights of the same color are formed respectively on both sides of each of the projecting walls 9*c* on which each of the address electrodes 10 is formed. For example, in the case where a color flat display device is formed, a fluorescent material R which emits a red light is provided in a groove portion between both the projecting walls 9 on both sides of one protruded wall 9*c*, and a fluorescent material B which emits a blue light and a fluorescent material G which emits a green light are provided respectively in groove portions respectively between another adjacent projecting walls 9*c* and the protruded wall 9 on both the sides of the protruded wall 9*c*.

In such a manner, the discharge is captured by cooperation of the projecting bar portions 6 and the projecting walls 9 on the first and second substrates 1 and 2 so that discharge areas which are separated from another one are formed, and in these areas pixel areas where lights of respective colors are emitted are formed.

An airtight space formed by the first and second substrates 1 and 2 is evacuated and necessary gas, i.e., one or more kinds of gas, selected from He, Ne, Ar, Xe and Kr, for example, such as mixed gas of Ne and Xe, namely, so-called Penning gas is sealed into the airtight space under air pressure of 0.05 to 5.0, for example. In this case, a gas circulating section which does not exert influence of the discharge on another portion can be formed so that the discharge areas can be evacuated and gas can be sealed smoothly.

According to the flat display device of the present invention, since the cathode glow discharge is utilized, namely, the cathode glow discharge is mainly utilized, namely, the spacing of a pair of the discharge maintaining electrodes can be set to less than 50 $\mu$m, preferably not more than 20 $\mu$m, the pixel pitch can be reduced, and high-definition and high-density display can be executed.

In addition, in the present invention, since the cathode glow discharge is utilized, the driving power can be reduced more than the case of negative glow discharge, and particularly the power consumption which becomes a problem in the large-screen display can be reduced.

There will be described blow a fabricating method of the flat display device according to one embodiment of the present invention. This embodiment refers to the case that the apparatus shown in FIGS. 1 through 3 is obtained, and one example will be described. However, the fabricating method of the present invention is not limited to this example.

At first, the description will be given as to one example of the fabricating method on the first substrate 1 side.

In this case, the transparent glass substrate 1, for example, is prepared, and the discharge maintaining electrodes 3 and 4 are formed on the inner surface of the substrates 1. As for the formation of the electrodes 3 and 4, a transparent electroconductive layer such as ITO is deposited on the.whole inner surface of the substrate 1 as thick as about 300 nm, for example, and the transparent electroconductive layer is pattern-etched by photolithography so that the discharge maintaining electrodes 3 and 4 with necessary patterns are formed. Namely, a photoresist layer is applied to ITO formed on the whole surface and baked, and is exposed and developed with the predetermined pattern so that an aimed etching mask which is disposed in parallel is formed. Then, this etching mask is used so that the transparent electroconductive layer is pattern-etched by an etching solution made of a mixed solution of hydrochloric acid and ferric chloride, and the discharge maintaining electrodes 3 and 4 are formed.

Next, the bus electrodes 3*b* and 4*b* are formed. At this time, at first, a material with excellent electroconductivity such as Al is vapor-evaporated on the whole inner surface of the first substrate 1 into as thick as about 1 $\mu$m so as to cover the discharge maintaining electrodes 3 and 4. Then, the above-mentioned pattern etching is executed by means of photolithography by using phosphoric acid as an etching solution so that the bus electrodes 3*b* and 4*b* are formed on the discharge maintaining electrodes 3 and 4 so as to cover a partial width of the electrodes 3 and 4.

The grid-state projecting bars 6 which are constituted by the projecting bar portions 6*y* and the intersecting projecting bar portions 6*x* are formed by a printing method, for example, in a height of 20 $\mu$m and a width of 30 $\mu$m to 40 $\mu$m, for example.

Thereafter, the dielectric layer 7 made of $SiO_2$, for example, is formed on the whole surface by the CVD (Chemical Vapor Depositions) method or the like, and MgO is vacuum-evaporated thereon as thick as about 0.5 $\mu$m to 1.0 $\mu$m so that the surface layer 8 is formed.

Meanwhile, as for the fabricating method on the second substrate 2 side having the address electrodes, at first the description will be given as to the case where the projecting walls 9 are formed by a printing method.

In this case, glass paste is overprinted plural times. A thickness per each printing in this case is about 10 $\mu$m, and this printing is repeated so that stripe printing at a height (thickness) of 50 $\mu$m to 80 $\mu$m is executed. Thereafter, baking at 500° C. to 600° C., for example, is executed. As a result, the projecting walls 9 at a height of 30 $\mu$m to 60 $\mu$m can be formed.

Figure 4A:
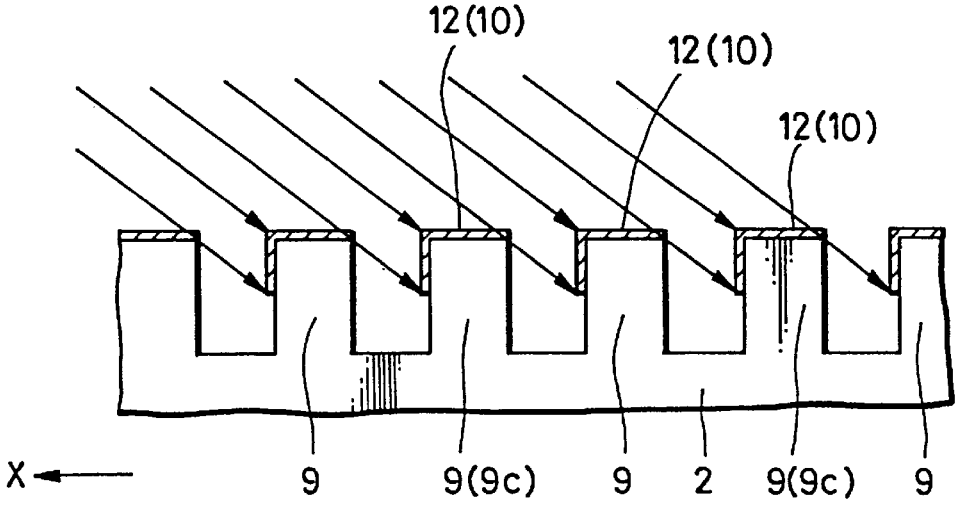
FIGS. 4A and 4B are cross sections of a main portion for description of features of the flat display device of the present invention.

Thereafter, the electroconductive layer is formed on top portions of at least every other projecting walls 9*c* of the projecting walls 9. When the electroconductive layer is formed, as shown in FIG. 4A, an electroconductive material such as Al is deposited from the diagonally upper direction X along the paper surface to the projecting walls 9 formed along the direction Y perpendicularly intersecting the paper surface of FIG. 4A according to the vacuum evaporation method, for example, having directional property in a direction where the electroconductive material flies, namely, so-called diagonal vacuum evaporation. As a result, a portion to which the electroconductive material 12 is not deposited is formed on base portions of the projecting walls 9 which are in the shade of the adjacent projecting walls 9 so that the electroconductive material 12 is formed isolatedly on each of the projecting walls 9. Therefore, the electroconductive material 12, which is separated from the electroconductive material 12 of the projecting walls 9 on both sides of the projecting walls 9*c*, is deposited on the every other projecting walls 9*c* so that the address electrodes 10 can be formed respectively on the projecting walls 9*c* by the separated electroconductive material 12.

Figure 4B:
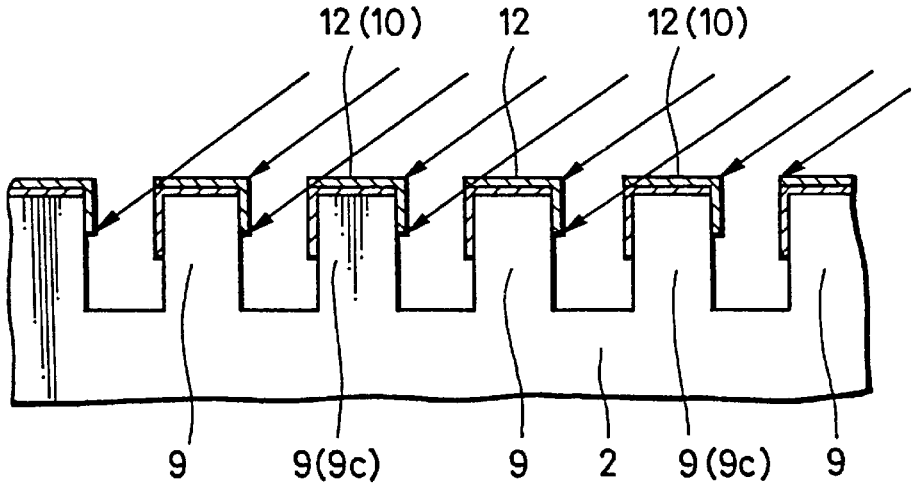

Further, as shown in FIG. 4B, as the need arises, the similar diagonal vacuum evaporation is executed from diagonally above on the opposite side to FIG. 4A so that the electroconductive:material 12 can be formed thicker.

In addition, thereafter as the need arises, in the example shown in FIGS. 1 and 2, the electroconductive material 12 on the projecting walls 9 other than the projecting walls 9*c* can be removed by pattern etching utilizing photolithography, but the electroconductive material 12 can remain on all the projecting walls 9.

Thereafter, photosensitive fluorescent slurry having fluorescent materials of respective colors is applied and baked successively into the grooves between the adjacent projecting walls 9 which sandwich the respective projecting walls 9*c* repeatedly. As shown in FIG. 1, the red, green and blue fluorescent materials R, G and B are deposited on both sides sandwiching the respective projecting walls 9*c* so that the fluorescent surfaces are formed.

Further, a surface layer 13 made of MgO or the like (not shown in FIG. 2) is formed on the whole surface.

In such a manner, the second substrate 2 is fabricated.

Thereafter, the first and second substrates 1 and 2 are made to oppose each other in the above-mentioned positional relationship, and are frit-sealed, and they are evacuated and gas is sealed thereinto so that the objective flat display device is formed.

In this case, the end portions of the bus electrodes 3*b* and 4*b* and the end portions of the address electrodes 10 are led out to the end portions of the substrates 1 and 2 which extend out of the airtight space so as to be used as feed terminals which are led to the discharge maintaining electrodes 3 and 4 and the address electrodes 10.

According to the above method of the present invention, in the case where the address electrodes are deposited on the top portions of the projecting walls 9*c* by the diagonally vacuum evaporation, the address electrodes 10 can be separated from each other easily. However, the method of forming the address electrodes 10 in the device of the present invention is not limited to the above-mentioned vacuum evaporation method utilizing diagonal flying, and a method of depositing on the whole surface and removing from the groove bottom portions by means of the pattern etching utilizing photolithography can be adopted.

In addition, in the above method, the glass paste is pattern-printed repeatedly, namely, overprinted so that the projecting walls 9 are formed. However, the glass paste is printed on the whole surface as thick as 50 $\mu$m to 80 $\mu$m and is dried, and a photosensitive film is laminated on the whole surface so as to be exposed and baked into a parallel stripe form, and is developed. Thereafter, the photosensitive film is sandblasted as a mask so that unnecessary glass layer portion is removed, and the photosensitive film is removed and baking is executed at 500° C. to 600° C. so that the projecting walls 9 at a predetermined height can be formed.

Figure 5A:
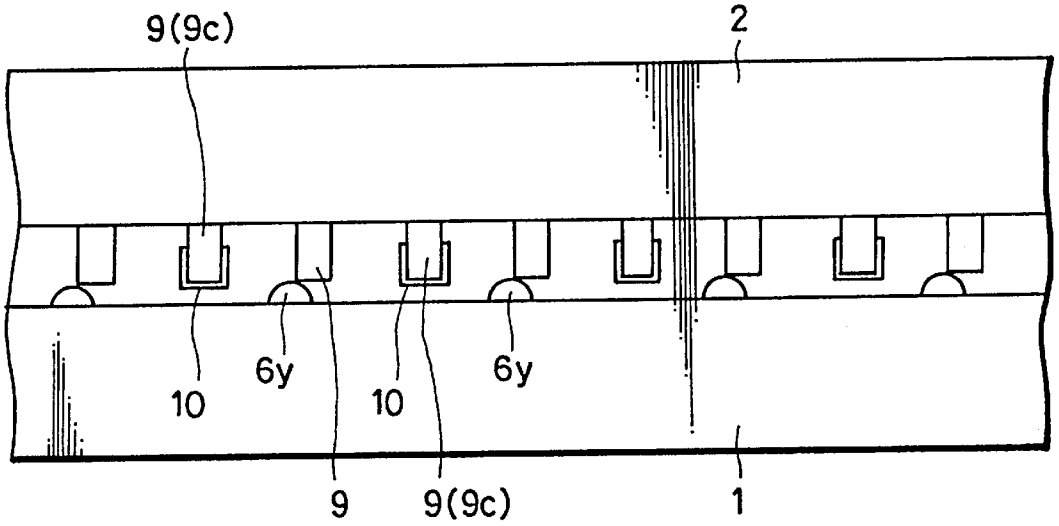
FIGS. 5A and 5B are cross sections of a main portion of a step of fabricating address electrodes in a method of fabricating the flat display device according to one embodiment of the present invention.
Figure 5B:
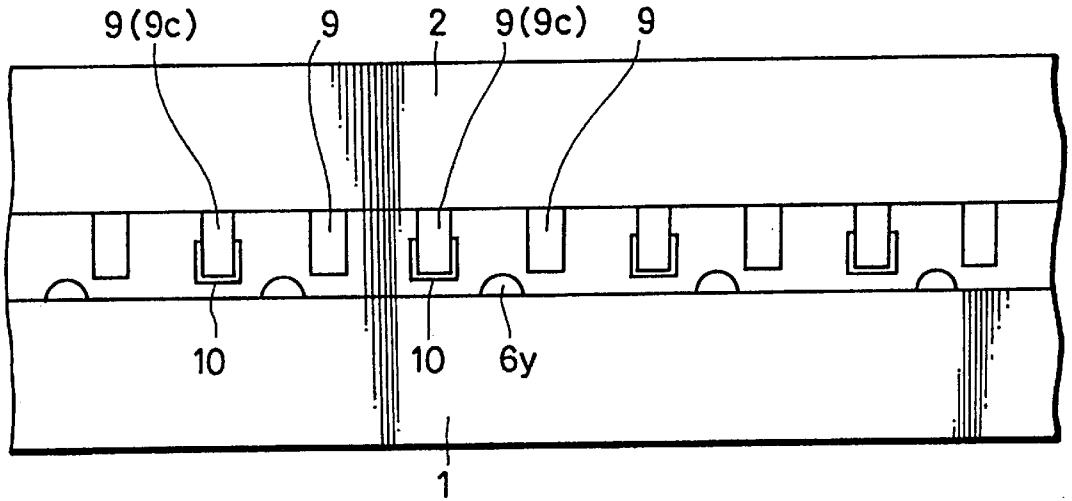

As mentioned above, in the step of fabricating the aimed flat display device, the heat treatment at a high temperature is given and thus the first and second substrates 1 and 2 contract, and as a result, as shown in FIGS. 5A and 5B, for example, the projecting walls 9 are occasionally displaced from the projecting bar portions 6*y*. However, also in this case, since the intersecting projecting bar portions 6*x* are formed and the projecting walls 9 can always come in contact with the intersecting projecting bar portions 6*x*, the spacing between the substrates 1 and 2, namely, the spacing between the address electrodes 10 and the discharge maintaining electrodes 3 and 4 can set to predetermined spacing, namely, to less than 50 $\mu$m, preferably not more than 20 $\mu$m.

Figure 6:
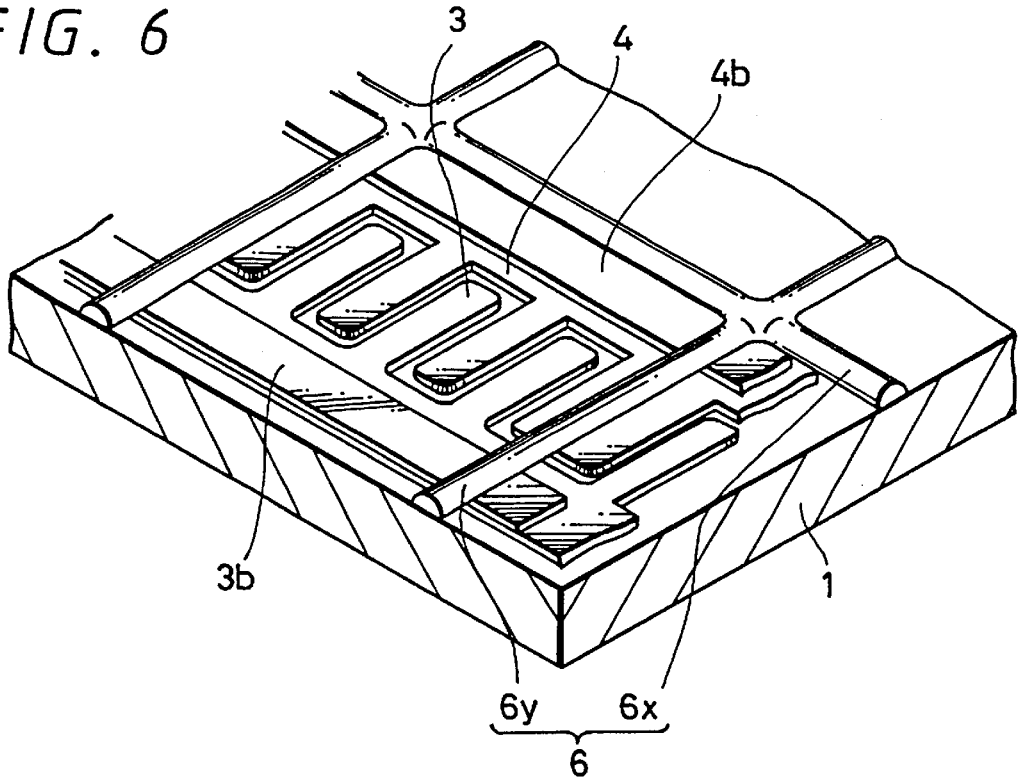
FIG. 6 is a perspective views of thew main portion showing an electrode arrangement in the flat display device according to another embodiment of the present invention.
Figure 7:
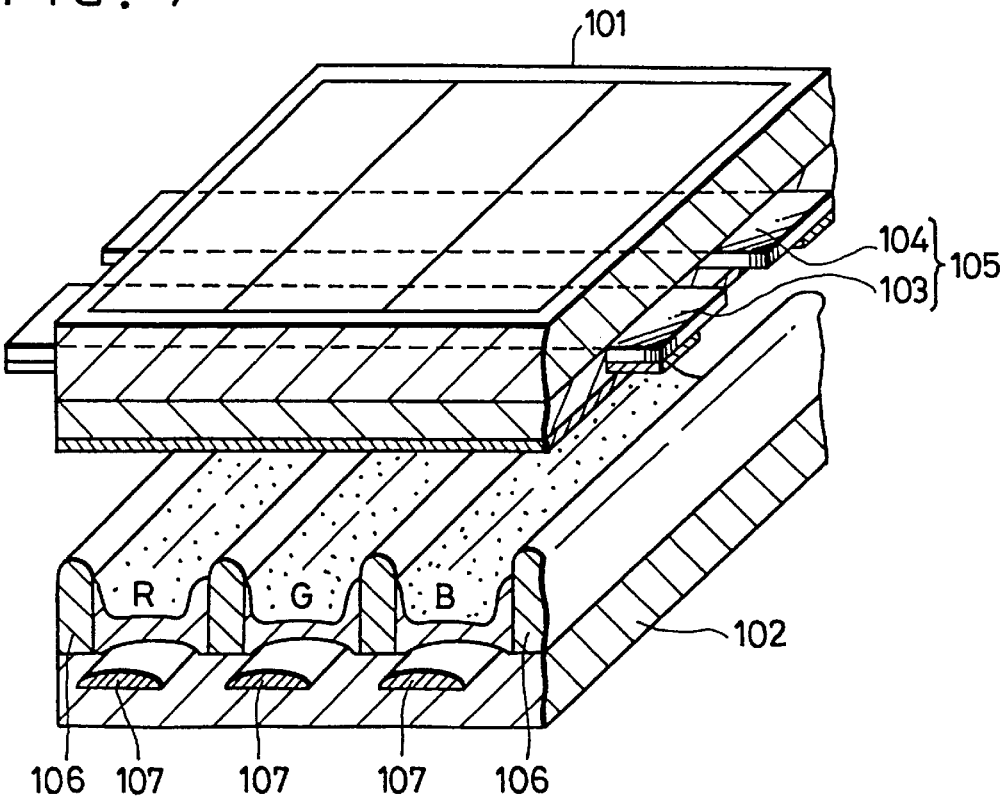
FIG. 7 is a perspective view of a conventional device.

The present invention is not limited to the above-mentioned example, and, for example, the mainly extended direction of the discharge maintaining electrodes 3 and 4 is the direction X, but,as shown in FIG. 6, the pattern of their countered portion can be a zig-zag pattern for lengthening the countered length.

In addition, the first and second substrates can be composed of the whole surface and rear panel constituting the airtight flat container constituting the flat display device, or can be constituted by countered substrates which are disposed in the airtight flat container. Namely, various modifications and changes can be made.

As mentioned above, according to the flat display device of the present invention, since there is provided the configuration in which the cathode glow discharge takes place, the spacing between the electrodes can be set to be narrow, i.e., to less than 50 $\mu$m, preferably not more than 20 $\mu$m. As a result, the pixel pitch can be reduced, and thus the high-definition and high-density display can be executed. In addition, since the present invention is constituted by a discharge mode mainly utilizing the cathode glow discharge, the driving power can be reduced further than the case of the negative glow discharge, and particularly the electricity-saving effect on the large-screen display can be improved.

In the actual fabrication, in the case the first and second substrates 1 and 2 are constituted by glass substrates, particularly low-priced lead glass or the like, the lead glass contracts greatly due to the heat treatment in the fabricating steps. This contraction occurs in a state such that the glass of 10 $\mu$m is contracted to 20 $\mu$m to 30 $\mu$m in the heat treatment at several 100° C. Further, its dispersion is great per product, and this contraction is different between a center portion and a peripheral portion of the screen. Moreover, in the case where the step of forming the electrodes of plural patterns is executed in one substrate, location of an exposure mask or the like in the pattern etching is displaced on respective portions, and the dispersion occurs per product. As a result, in the case where the distance between the discharge electrodes is set to less than 50 $\mu$m, preferably not more than 20 $\mu$m particularly for the cathode glow discharge, high accuracy is required particularly for its dimension accuracy, and thus there arise problems of yielding and reliability.

However, as mentioned above, when a pair of the discharge maintaining electrodes are formed on the first substrate 1 and the address electrodes are formed on the second substrate 2, the pair of discharge maintaining electrodes are formed in the same step, and the address electrodes are formed on the second substrate 2 which is the different side where the discharge maintaining electrodes are formed. As a result, since mutual influence of displacement due to the heat is avoided, even in the case where the cathode glow discharge is allowed to take place as for starting discharge and maintaining discharge, the spacing between the address electrodes and the discharge maintaining electrodes and the spacing between the discharge maintaining electrodes can be set to the aimed spacing with high accuracy.

In addition, as mentioned above, when the projecting bars 6 are formed into a grid-state, even if the substrates 1 and 2 are displaced, the spacing between the substrates 1 and 2, namely, the spacing between the address electrodes and the discharge maintaining electrodes can be maintained at the predetermined spacing.

In addition, according to the fabricating method of the present invention, when the projecting walls 9 are formed on the second substrate and address electrodes are formed on the top portions of the projecting walls 9 by diagonal flying, the electroconductive material can be formed isolatedly on the top portions of the projecting walls 9. As a result, a step of separating the electroconductive material between the projecting walls is omitted, and the fabrication is simplified.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A flat display device, wherein:

first and second substrates are disposed so as to oppose each other;

a discharge maintaining electrode group which is constituted so that a plurality of discharge maintaining electrodes are disposed is formed on said first substrate;

an address electrode group which is constituted so that a plurality of address electrodes are disposed is formed on said second substrate; and a plasma discharge display is executed by a cathode glow discharge.

2. The flat display device according to claim 1, wherein said discharge maintaining electrodes are disposed so that their main extended direction faces towards a first direction along a surface of said first substrate;

a plurality of projecting walls which are extended to a second direction crossing the first direction are disposed in parallel on said second substrate along a surface of said second substrate; and said address electrodes are formed respectively on top portions of at least every other projecting walls of said projecting walls.

3. The flat display device according to claim 1, wherein spacing between said address electrodes formed on the top portions of said projecting walls and said discharge maintaining electrodes which face said address electrodes is set to less than 50 $\mu$m so that a cathode glow discharge is started.

4. The flat display device according to claim 1, wherein spacing between said address electrodes formed on the top portions of said projecting walls and said discharge maintaining electrodes which face said address electrodes is set to not more than 20 $\mu$m so that a cathode glow discharge is started.

5. The flat display device according to claim 2, wherein grid-state projecting bars, which are constituted by projecting bar portions extending along the second direction and intersecting projecting bar portions extending along the first direction and crossing said projecting walls on the first substrate, are formed on said first substrate.

6. The flat display device according to claim 1, wherein color fluorescent materials are formed on said second substrate so that color display is executed.

7. The flat display device according to claim 6, wherein a fluorescent material of the same color as that of the color fluorescent material is applied to both sides of said second substrate which sandwich said address electrodes.

8. The flat display device according to claim 1, wherein the spacing of a pair of said discharge maintaining electrodes is set to less than 50 $\mu$m.

9. The flat display device according to claim 1, wherein the spacing of a pair of said discharge maintaining electrodes is set to not more than 20 $\mu$m.

* * * * *